US009797029B2

(12) United States Patent
Fujii et al.

(10) Patent No.: US 9,797,029 B2
(45) Date of Patent: Oct. 24, 2017

(54) HEAT RESISTANT TITANIUM ALLOY SHEET EXCELLENT IN COLD WORKABILITY AND A METHOD OF PRODUCTION OF THE SAME

(71) Applicant: Nippon Steel & Sumitomo Metal Corporation, Tokyo (JP)

(72) Inventors: Hideki Fujii, Tokyo (JP); Hiroaki Otsuka, Tokyo (JP); Kazuhiro Takahashi, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/455,013

(22) Filed: Aug. 8, 2014

(65) Prior Publication Data

US 2014/0348697 A1 Nov. 27, 2014

Related U.S. Application Data

(63) Continuation-in-part of application No. 10/592,892, filed as application No. PCT/JP2005/005292 on Mar. 16, 2005, now abandoned.

(30) Foreign Application Priority Data

Mar. 19, 2004 (JP) ..... 2004-080280
Mar. 10, 2005 (JP) ..... 2005-067175

(51) Int. Cl.
*C22F 1/18* (2006.01)
*C22C 14/00* (2006.01)
*C22F 1/00* (2006.01)

(52) U.S. Cl.
CPC ..... *C22C 14/00* (2013.01); *C22F 1/00* (2013.01); *C22F 1/18* (2013.01); *C22F 1/183* (2013.01); *F01N 2530/00* (2013.01)

(58) Field of Classification Search
CPC ..... C22C 14/00; C22F 1/00
USPC ..... 420/421, 417; 148/669
See application file for complete search history.

(56) References Cited

U.S. PATENT DOCUMENTS 5,141,565 A 8/1992 Kramer et al.
2012/0148437 A1 6/2012 Fujii et al.

FOREIGN PATENT DOCUMENTS

| | | |
|---|---|---|
| EP | 0 812 924 | 12/1997 |
| EP | 0 992 599 | 4/2000 |
| EP | 1 400 604 | 3/2004 |
| GB | 1 278 887 | 6/1972 |
| JP | 62 087932 | 4/1987 |
| JP | 63270449 | 11/1988 |
| JP | 05279773 | 10/1993 |
| JP | 8 165533 | 6/1996 |
| JP | 11-080867 A | 3/1999 |
| JP | 11080867 | 3/1999 |
| JP | 2000-096165 | 4/2000 |
| JP | 2001-234266 | 9/2001 |
| JP | 2003326389 | 11/2003 |
| JP | 2004002953 | 1/2004 |

OTHER PUBLICATIONS

European Search Report dated Nov. 3, 2010 issued in corresponding European Patent Application No. EP 05 72 1342.
European Search Report dated Apr. 20, 2011 issued in corresponding European Patent Application No. EP 11 15 5253.
Kinzoku Binran, Edited by the Japan Institute of Metals, revised edition, 5th print, Maruzen Co., Ltd, Oct. 5, 1996, p. 639, [with English Translation].
NPL: Online translation of JP 2004-002953A (publication date: Jan. 8, 2004).
Machine translation of JP 2000-096165A, 4, 2000.
Japanese Office Action in Japanese Patent Application No. 2005-067175, dated Dec. 22, 2009.
Phase Diagrams of Binary Titanium Alloys; The Cu—Ti (Copper-Titanium) System by Joanne L. Murray; First Printing, Aug. 1987; ASM International; p. 80.

*Primary Examiner* — Jie Yang
(74) *Attorney, Agent, or Firm* — Birch, Stewart, Kolasch & Birch, LLP

(57) ABSTRACT

The present invention provides a heat resistant titanium alloy sheet excellent in cold workability having high temperature strength characteristics better than JIS Class 2 pure titanium and having a cold workability and high temperature oxidation resistance equal to or better than that of JIS Class 2 pure titanium and a method of production of the same, that is, a heat resistant titanium alloy sheet excellent in cold workability characterized by comprising, by mass %, 0.3 to 1.8% of Cu, 0.18% or less of oxygen, 0.30% or less of Fe, and, as needed, at least one of Sn, Zr, Mo, Nb, and Cr in a total of 0.3 to 1.5%, and the balance of Ti and less than 0.3% of impurity elements and by a β-phase and $Ti_2Cu$-phase being included in a volume percentage of 0 to 2% and, further, a method of production of that titanium alloy sheet characterized by performing the final annealing at 630 to 850° C. in temperature range or performing the hot-rolled sheet or coil annealing or intermediate annealing at 630 to 850° C. in temperature range and perform the final annealing after cold working at 600 to 630° C. in temperature.

2 Claims, No Drawings

HEAT RESISTANT TITANIUM ALLOY SHEET EXCELLENT IN COLD WORKABILITY AND A METHOD OF PRODUCTION OF THE SAME

CROSS-REFERENCE TO RELATED APPLICATION

This application is a Continuation-in-Part of U.S. patent application Ser. No. 10/592,892, filed Sep. 15, 2006, which is a 35 U.S.C. §371 of PCT/JP2005/05292 filed Mar. 16, 2005, which claims priority to Japanese Application Nos. 2005-067175, filed Mar. 10, 2005, and 2004-080280, filed Mar. 19, 2004, all of which are incorporated herein by reference in their entirety.

TECHNICAL FIELD

The present invention relates to a heat resistant titanium alloy sheet excellent in cold workability and a method of production of the same, more particularly relates to a heat resistant titanium alloy sheet excellent in cold workability suited for exhaust system parts of two-wheeled and four-wheeled vehicles and other applications where characteristics in a high temperature range and cold workability are required and a method of production of the same.

BACKGROUND ART

The exhaust system of a two-wheeled or four-wheeled vehicle (hereinafter referred to as an "automobile") is comprised of an exhaust manifold, exhaust pipe, muffler, and other parts. To enable it to withstand high temperature exhaust gas or to cope with complicated shapes, stainless steel excellent in corrosion resistance, high temperature strength, workability, etc. is being made considerable use of.

However, in recent years, pure titanium, which has a corrosion resistance superior to stainless steel, is light in weight, is excellent in workability as well, has a small heat expansion coefficient, is superior in heat fatigue characteristics, and is excellent in terms of aesthetic design due to its unique color and impression, has started to be used in the exhaust systems of some automobiles, in particular for the mufflers. The amount used has been rapidly increasing.

A muffler is the final part in an exhaust system. The exhaust gas there has been cooled to a certain extent. Further, it is frequently used for the outside pipe exposed to the outside air for design purposes. For this reason, pure titanium, which is not that high in high temperature strength, can also be used for muffler applications. Rather, the excellent cold workability of pure titanium is being utilized for working the metal into complicated shapes.

Such pure titanium parts, like stainless steel parts, are mainly made of cold rolled annealed thin-gauge sheet which is bent, press formed, drawn, and enlarged in holes (bored) or is bent and welded to form welded pipe or is cold worked in various ways to form it into the desired shape for use.

Such pure titanium thin-gauge sheet is generally produced by the following process. That is, VAR (vacuum arc remelting) or EBR (electron beam remelting) or another remelting process is used to form an ingot, this is hot forged or break-down rolled to form a slab, then this is hot rolled to form a hot rolled strip and further descaled, then cold rolled to form a cold rolled strip. Alternatively, this is cut to produce cut sheet products.

Note that during these processes, the metal may be annealed as required before the cold rolling (after the hot rolling) or in the middle of the cold rolling. Further, the final cold rolled strip is also generally annealed.

On the other hand, the exhaust pipe or exhaust manifold near the engine is often exposed to a high temperature. If trying to use a titanium material for the inside and outside pipes of a muffler of an automobile with a high exhaust temperature, it would be necessary to use thick pure titanium to reinforce the strength or use an alloy excellent in high temperature strength such as Ti-3Al-2.5V alloy.

However, using thick pure titanium has the problem of detracting from the special feature of titanium of its light weight, Further, an alloy having 3% or so of Al such as a Ti-3Al-2.5V alloy is poor in cold workability. Therefore, there were the problems that the cold rollability to thin-gauge sheet of the material when producing pipe for an exhaust system part was impaired or the cold formability such as pipe bending dropped.

To solve the above problems, Japanese Patent Publication (A) No. 2001-234266 discloses an invention relating to a titanium alloy for muffler use to which 0.5 to 2.3 mass % of Al has been added, that is, a titanium alloy for an exhaust system part superior to even pure titanium in heat resistance and oxidation resistance and having a cold rollability equal to that of pure titanium.

Japanese Patent Publication (A) No. 63-270449 discloses art relating to titanium sheet which secures ductility and gives a small anisotropy of yield strength even in one-directional rolling. This, by addition of Fe, Cu, Si, etc. even with low oxygen, causes Ti—Fe-based or Ti—Cu-based and other compounds to finely and uniformly disperse and precipitate in the α-phase matrix in the crystal grains. Due to this, twinning is inhibited in the next performed rolling, slip is assisted, and the shapeability is improved.

WO03/085144 proposes titanium alloy for auto parts which has Fe added to 0.15 to 0.50%, suppresses the formation of the β-phase, is mainly comprised of the α-phase, and is provided with both strength and ductility.

Japanese Patent Publication (A) No. 2004-2953 proposes titanium alloy for use for a drum for producing Cu foil which is limited in oxygen to become soft and good in workability and which is limited in Fe to inhibit the formation of the β-phase and reduce the formation of pits due to corrosion. Further, by addition of Cu, the structure is rendered a two phase one of α+β in the temperature range of hot rolling whereby a homogeneous fine structure is obtained and macropatterns are reduced.

Japanese Patent Publication (A) No. 11-80867 discloses titanium alloy which makes use of the characteristic of titanium of being excellent in resistance to seawater corrosion and which further has an antibacterial property and biofouling resistance. This titanium material is comprised of an α-phase, a β-phase with concentrated Cu, or a $Ti_2Cu$ phase. This is characterized by adjusting the working and heat treatment so as to change the α-phase from a needle shape to an equiaxial one and improve the antibacterial property and biofouling resistance.

Japanese Patent Publication (A) No. 2000-96165 is a further improvement over the titanium alloy of Japanese Patent Publication (A) No. 11-80867. It is characterized by having concentrated regions of Cu formed at the grain boundaries of the β-phase and having equiaxial crystals given an average particle size of 100 μm or less to enable close arrangement of concentrated Cu parts and improve the antibacterial property and biofouling resistance.

DISCLOSURE OF THE INVENTION

However, the invention described in the above Japanese Patent Publication (A) No. 2001-234266 does indeed have an excellent cold rollability equal to that of the JIS Class 2 pure titanium made much use of for mufflers, but as shown in Table 1 and FIGS. 2 to 4 of that publication, compared with JIS Class 2 pure titanium, the yield strength is high and the ductility is low, so when the sheets or the pipes produced using the same are bent, enlarged, reduced, enlarged in hole size (bored), or otherwise secondarily worked, a further higher cold workability is sought.

The titanium alloy which is described in Japanese Patent Publication (A) No. 63-270449 is indeed improved in workability, but Ti—Cu and other compounds are made to precipitate in the α-phase, so a high strength cannot be obtained in a high temperature region as explained in the below "BEST MODE FOR WORKING THE INVENTION". For this reason, this is not being applied to actual exhaust system parts.

The titanium alloy which is described in WO03/085144 has a room temperature strength and ductility equal to those of JIS Class 2 pure titanium. Examples of use for exhaust system parts are disclosed. However, the solution strengthening element Cu is not included, so a superior high-temperature strength cannot be obtained as explained in the below "BEST MODE FOR WORKING THE INVENTION".

Japanese Patent Publication (A) No. 2004-2953 is an invention of titanium sheet which is used for a drum for copper foil. Its main focus is on suppression of macropatterns due to corrosion. It has corrosion resistance with respect to the electrolytic solution, but does not have high temperature strength and naturally cannot be applied to exhaust system parts.

Japanese Patent Publication (A) No. 11-80867 and Japanese Patent Publication (A) No. 2000-96165 stress the functions of the antibacterial property and biofouling resistance, so are not designed material-wise in pursuit of high temperature strength and high temperature corrosion resistance. Basically, Cu is added for the purpose of biofouling resistance, so concentrated parts of Cu are essential and how evenly the concentrated Cu regions are formed is important. Therefore, naturally, application to exhaust parts is not possible.

Further, in ships etc. as well, there is a strong need for reducing the weight of the exhaust system parts which are exposed to high temperatures. A titanium material excellent in both workability and high temperature strength has therefore been strongly sought.

The present invention was made taking note of the above situation and has as its object the provision of heat resistant titanium alloy sheet excellent in cold workability having high temperature strength characteristics better than JIS Class 2 pure titanium and having cold workability and high temperature oxidation resistances equal to or better than those of JIS Class 2 pure titanium and a method of production of the same.

To solve the above problems, the present invention has the following means as its framework:

(1) A heat resistant titanium alloy sheet excellent in cold workability characterized by comprising, by mass %, 0.3 to 1.8% of Cu, 0.18% or less of oxygen, 0.30% or less of Fe, and the balance of Ti and less than 0.3% of impurity elements and by a β-phase and $Ti_2Cu$-phase in total having a volume percentage of 2% or less and the balance of an α-phase.

(2) A heat resistant titanium alloy sheet excellent in cold workability as set forth in the above (1), characterized in that said titanium alloy sheet further contains at least one or more of Sn, Zr, Mo, Nb, and Cr in a total of 0.3 mass % to 1.5 mass %.

BEST MODE FOR WORKING THE INVENTION

The inventors carefully evaluated the effects of ingredient elements in the high temperature strength, oxidation resistance, and cold workability of titanium so as to solve the above problems and as a result discovered that if adding a certain amount of Cu to the titanium, it is possible, without impairing the cold workability or oxidation resistance, to remarkably improve the high temperature strength in the temperature range in which automobile exhaust system members etc. are used, i.e., about 500 to about 700° C. The present invention was completed based on this epoch making discovery.

Now, in the invention described in claim 1 (hereinafter referred to as "the present invention (1)"), the alloy is comprised of, by mass %, 0.3 to 1.8% of Cu, 0.18% or less of oxygen, 0.30% or less of Fe, and the balance of Ti and less than 0.3% of impurity elements and has a β-phase and $Ti_2Cu$-phase which are in total a volume percentage of 2% or less has a balance of an α-phase.

If adding Cu to titanium, it enters into solid solution in the α-phase in as much as 1.5%. This solid solution Cu, like Al, has the effect of increasing the high temperature strength by solid solution strengthening. On the other hand, in Al-added titanium and Cu-added titanium, a remarkable difference appears in the cold workability.

That is, if cold working Al-added titanium, not only does the slip deformation responsible for deformation become harder to occur, but also the occurrence of twinning deformation, the main reason for the high workability of titanium, is suppressed, the yield strength becomes higher, and the ductility falls. As a result, the cold workability falls.

However, with Cu-added titanium, while the slip deformation is suppressed by the solution strengthening, the occurrence of twinning deformation is not impaired at all. The result is like pure titanium. As a result, a low yield strength and ductility on a par with Class 2 pure titanium are maintained. Of course, this effect is an effect expressed when the twinning deformation is the main deformation mechanism. Like with Al, oxygen, which as an effect of suppression of the occurrence of twinning, has to be limited to the upper limit value for active twinning, that is, 0.18% or less.

Here, the amount of addition of Cu is given an upper limit of 1.8% because if Cu is added over this, a $Ti_2Cu$ phase and β-phase will be formed in a large amount and the cold workability will be impaired. Further, the amount of addition of Cu is given a lower limit of 0.3% because to sufficiently bring out a high temperature strength, the Cu has to be added in an amount of 0.3% or more.

Note that content of Fe has to be 0.30% or less. Fe is an element stabilizing the β-phase and causes the formation of the β-phase in the high temperature range in the manufacturing process. If the content of Fe is 0.30% or less, the amount of formation of the β-phase is slight, but if more than this is added, the amount of the β-phase increases, Cu, an element which easily concentrates at the β-phase, will concentrate there heavily, during cooling, most transforms to the α-phase and harmful amounts of the $Ti_2Cu$ phase and β-phase become included, and the amount of solid solution of Cu in the α-phase required for improving the high temperature strength will fall. Therefore, to suppress the formation of an excessive β-phase so as not to exceed 2% in volume percentage, Fe has to be made 0.30% or less.

However, nitrogen, carbon, Ni, Cr, Al, Sn, Si, hydrogen, and other elements normally contained in a titanium material as impurity elements and other elements may be contained without problem if the total does not impair the workability, i.e., is less than 0.3%.

Further, the high temperature oxidation resistance, an important characteristic to be possessed by a heat resistant material like high temperature strength, is not impaired at all even if Cu is added.

In the alloy of the present invention (1), from the viewpoint of the workability, the content of oxygen is preferably 0.10% or less. This is because, with this range of oxygen amount, the occurrence of twinning is further promoted and the workability is further improved. Oxygen has almost no effect on the high temperature strength, so even if limiting the oxygen to 0.10% or less, the high temperature characteristics are not impaired at all.

This type of effect can be manifested further by limiting the content of oxygen to 0.06% or less. That is, in the alloy of the present invention (1), if the content of oxygen is 0.06% or less, the effect of the present invention is exhibited the strongest.

Note that, as explained above, the present invention uses Cu in solid solution in the α-phase so as to raise the high temperature strength. Therefore, it is necessary to avoid the formation of the phases which reduce the amount of solid solution Cu in the α-phase such as the $Ti_2Cu$ phase and β-phase as much as possible. That is, it would be ideal if the $Ti_2Cu$ phase and β-phase did not exist at all, that is, if the structure were a 100% α-phase. However, sometimes the $Ti_2Cu$ phase and β-phase are formed in the production process. The $Ti_2Cu$ phase and the β-phase differ in amounts of production and form depending on the working conditions, heat treatment conditions, compositions, product shapes, dimensions, and various other influencing factors. To prevent the $Ti_2Cu$ phase and the β-phase from causing a drop in the high temperature characteristics of the titanium alloy, their volume percentage must be made, in total, 2% or less. This is because if over 2%, the amount of solid solution Cu in the α-phase is reduced and the desired high temperature strength can no longer be obtained.

Next, the present invention described in claim 2 (hereinafter referred to as "the present invention (2)") will be explained. In the present invention (2), there is provided the alloy of the present invention (1) further containing at least one or more of Sn, Zr, Mo, Nb, and Cr in a total of 0.3 mass % to 1.5 mass %.

This is to try to further improve the high temperature strength of the alloy of the present invention (1) and to try to further improve the high temperature oxidation resistances. Sn, Zr, Mo, Nb, and Cr all enter the α-phase to a certain extent in solid solution and overlap with the Cu to raise the high temperature strength. Further, simultaneously, the high temperature oxidation characteristics are also improved.

However, the amount of addition has to be, in total, 0.3% or more. This is because if not the above amount of addition, an improvement in the high temperature strength and an improvement in the high temperature oxidation resistance cannot be obtained. Further, the amount of addition has to be, in total, not more than 1.5%. This is because these elements have the effect of promoting the precipitation of $Ti_2Cu$. If added in a large amount, the amount of production of $Ti_2Cu$ increases and therefore the workability is impaired. However, if the total of these elements is 1.5% or less, this effect is small and the amount of production of $Ti_2Cu$ will never exceed 2% in volume percentage.

Such heat resistant titanium alloy which is excellent in cold workability, in particular the thin-gauge sheet which is used in large amounts in the exhaust systems of automobiles, is produced by the steps of remelting, hot rolling, cold rolling, and final annealing. If necessary, after hot rolling, the hot rolled sheet or coil is annealed. At that time, the hot rolled sheet or coil is preferably annealed at 630 to 850° C. in temperature range for 1 minute or more. When not annealing the hot rolled sheet or coil, the final annealing after cold rolling has to be performed in this temperature range.

This condition aims at increasing the amount of solid solution Cu as much as possible from the viewpoint of the workability and the high temperature strength. Of course, even if performing annealing or other heat treatment outside of this temperature range, if the ingredients are those of the present invention (1) or (2), the effects of the present invention are sufficiently exhibited so long as the spot distributed β-phase and $Ti_2Cu$ phase satisfy the requirement of a total of a volume percentage of 2% or less, but if performing the annealing in this temperature range, the effect of the present invention can be further enhanced.

That is, temperature range between 630 and 850° C. is a "single α-phase region" or a "substantially single α-phase region" containing a small amount of the $Ti_2Cu$ phase but mostly comprised of the α-phase or a "temperature range which can finally achieve a phase constitution comprised of substantially the α-phase" which is a two phase region of α+β, but is mainly comprised of the α-phase and which contains an amount of β-phase which can mostly be made to change to the α-phase during cooling. It is effective to select the above annealing temperature where the volume ratio of the α-phase becomes maximum by the Cu content. This means, in other words, to perform annealing in a temperature range where the amount of Cu in solid solution in the α-phase becomes larger, that is, the temperature range where the volume ratio of the α-phase becomes maximum. By annealing in this temperature range, it is possible to reduce the volume ratio of the $Ti_2Cu$ or β-phase. As a result, it becomes possible to increase the amount of Cu in solid solution in the α-phase. In particular, it is possible to raise the high temperature strength. The holding time in this temperature range should be 1 minute or more. If the holding temperature is less than 700° C., the holding time is preferably made 5 minutes or more. Note that if $Ti_2Cu$ is produced during the cooling after the annealing, it is pointed out that the targeted annealing effect ends up being impaired, but $Ti_2Cu$ precipitates very slowly. With the cooling rate of the extent of air cooling or furnace cooling, not enough of an amount of $Ti_2Cu$ is produced for the annealing effect to be impaired, that is, exceeding 2%. Further, the β-phase which is present in the high temperature range of the temperature range of 630 to 850° C. mostly changes to the α-phase at the time of passing through the α-phase region during cooling. This is due to the fact that the β→α phase transformation is fast in this alloy system.

Further, if once annealing at 630 to 850° C. in temperature range, even if later cold working the alloy and again annealing it at less than 630° C. in temperature, since $Ti_2Cu$ precipitates slowly, within the actual heat treatment time, almost no $Ti_2Cu$ will be produced. That is, $Ti_2Cu$ never exceeds 2%. Therefore the large amount of Cu in solid solution in the α-phase can be maintained.

If performing the annealing before the final cold rolling (hot-rolled sheet or coil annealing) at 630 to 850° C. in temperature range, even if performing the final annealing after the cold rolling at less than 630° C. in temperature, the large amount of Cu in solid solution in the α-phase can be maintained. However, if the final annealing temperature after cold rolling is less than 600° C., strain becomes difficult to remove and softening becomes difficult, so sufficient cold workability cannot be obtained, so this is preferably avoided. Further, if made 700° C. or more, there is a possibility of a $Ti_2Cu$ phase or β-phase again being produced, so this is preferably avoided. Preferably, the temperature is made less than 650° C., more preferably less than 630° C. The reduction rate of the cold rolling is not particularly limited, but there is no problem so long as it is 4% or more.

EXAMPLES

Example 1

VAR (vacuum arc remelting) was used to remelt the titanium material of each composition shown in Table 1. This was hot forged to form a slab which was then heated to 860° C., then hot rolled by a hot continuous rolling mill to a strip of a thickness of 3.5 mm.

This hot rolled strip was continuously annealed with air cooling at 720° C.×2 minutes (hot-rolled coil annealing), then the oxide scale was removed by shot blast and pickling, then the strip was cold rolled to a strip of a thickness of 1 mm. After this, the strip was vacuum annealed with furnace cooling at 680° C.×4 hours (final annealing). A tensile test piece was taken in parallel with the rolling direction and was used for tensile tests at room temperature, 550° C., 625° C., and 700° C. The strength characteristics were evaluated by the 0.2% proof stress or yield stress (hereinafter referred to as "0.2% yield strength"), while the workability was evaluated by the elongation value at room temperature. Further, a 30 mm×30 mm square test piece was heat treated at 700° C.×200 hours in the air and measured for increase in weight due to oxidation. Further, examination of the structure by a scan type electron microscope reveals second phases ($Ti_2Cu$ phase and β-phase). The area rate was calculated by image analysis so as to find the volume percentage of the second phases. The results of these evaluations are shown together in Table 1.

TABLE 1

| Test no. | Cu (mass %) | Al (mass %) | Fe (mass %) | O (mass %) | Room temperature 0.2% yield strength (MPa) | Room temperature elongation (%) | 550° C. 0.2% yield strength (MPa) | 625° C. 0.2% yield strength (MPa) | 700° C. 0.2% yield strength (MPa) | 700° C., 200 h oxidation weight increase (mg/cm$^2$) | Total amount of $Ti_2Cu$, β-phase (volume percentage) (%) | Remarks |
|---|---|---|---|---|---|---|---|---|---|---|---|---|
| 1 | — | — | 0.05 | 0.18 | 275 | 39.5 | 60 | 21 | 8 | 3.02 | * | Conv. mat. |
| 2 | — | 1.1 | 0.05 | 0.13 | 310 | 28.9 | 105 | 62 | 20 | 2.98 | * | Conv. mat. |
| 3 | — | 2.1 | 0.05 | 0.08 | 403 | 25.2 | 126 | 81 | 37 | 2.94 | * | Conv. mat. |
| 4 | 0.2 | — | 0.05 | 0.08 | 205 | 40.6 | 65 | 28 | 11 | 2.97 | * | Comp. ex. |
| 5 | 0.4 | — | 0.05 | 0.08 | 203 | 41.8 | 101 | 80 | 31 | 3.01 | * | Inv. (1), (3) |
| 6 | 0.8 | — | 0.05 | 0.08 | 207 | 41.0 | 116 | 87 | 35 | 2.96 | * | Inv. (1), (3) |
| 7 | 1.6 | — | 0.05 | 0.08 | 211 | 40.3 | 133 | 95 | 41 | 3.02 | 1.4 | Inv. (1), (3) |
| 8 | 2.0 | — | 0.05 | 0.08 | 220 | 31.8 | 135 | 97 | 44 | 3.00 | 2.3 | Comp. ex. |
| 9 | 0.8 | — | 0.15 | 0.08 | 202 | 40.5 | 118 | 89 | 36 | 3.03 | 0.3 | Inv. (1), (3) |
| 10 | 0.8 | — | 0.26 | 0.08 | 225 | 40.1 | 116 | 88 | 40 | 2.99 | 0.5 | Inv. (1), (3) |
| 11 | 0.8 | — | 0.33 | 0.08 | 232 | 37.2 | 103 | 75 | 18 | 3.05 | 2.2 | Comp. ex. |
| 12 | 1.1 | — | 0.06 | 0.12 | 251 | 38.3 | 118 | 90 | 38 | 2.99 | 0.1 | Inv. (1), (3) |
| 13 | 1.1 | — | 0.05 | 0.16 | 279 | 36.2 | 120 | 88 | 37 | 2.96 | 0.2 | Inv. (1), (3) |
| 14 | 1.1 | — | 0.05 | 0.20 | 301 | 30.5 | 120 | 87 | 37 | 2.98 | 0.3 | Comp. ex. |
| 15 | 1.5 | — | 0.05 | 0.16 | 280 | 35.8 | 130 | 97 | 41 | 3.08 | 1.5 | Inv. (1), (3) |
| 16 | 1.0 | — | 0.04 | 0.07 | 207 | 42.5 | 115 | 88 | 36 | 3.01 | 0.1 | Inv. (1), (3) |
| 17 | 1.0 | — | 0.04 | 0.04 | 195 | 47.5 | 114 | 86 | 35 | 2.96 | 0.1 | Inv. (1), (3) |
| 18 | 1.0 | — | 0.03 | 0.02 | 189 | 48.3 | 115 | 87 | 34 | 3.00 | 0.1 | Inv. (1), (3) |

* below detection limit

In Table 1, Test No. 1 is an example of JIS Class 2 commercially pure titanium, while Test Nos. 2 and 3 are examples of alloys to which Al has been added in an extent of 1 to 2%. Test No. 1 has an elongation at room temperature of as much as 39.5% and a sufficient cold workability, but the 0.2% yield strength at high temperatures is poor being only 60 MPa at 550° C., 21 MPa at 625° C., and 8 MPa at 700° C., i.e., the high temperature strength is insufficient.

As opposed to this, Test Nos. 2 and 3 to which Al are added have 0.2% yield strengths at 550° C., 625° C., and 700° C. all far above that of the pure titanium of Test No. 1, i.e., high high-temperature strength is achieved, the elongation at room temperature is 30% or less, and the cold workability is insufficient.

In this way, if a small amount of Al is added, the high temperature strength is improved, but the cold workability falls. The market demand for a titanium alloy satisfying both requirements is not been achieved by this.

As opposed to this, Test Nos. 5, 6, 7, 9, 10, 12, 13, 15, 16, 17, 18 representing examples of the present invention (1) produced by the method described in the present invention (3) all have high elongations at room temperature of at least 35% and have 0.2% yield strengths at 550° C., 625° C., and 700° C. of at least 100 MPa, at least 80 MPa, and at least 30 MPa. Both an excellent cold workability and high high-temperature strength are achieved, i.e, the effect of the present invention is sufficiently exhibited.

In particular, in Test Nos. 5, 6, 7, 9, 10, 16, 17, and 18 where the content of oxygen is 0.10% or less, 40% or higher elongations at room temperature are obtained, that is, the effects of the present invention (1) are sufficiently exhibited. In particular, in Test Nos. 17 and 18 where the content of oxygen is 0.06% or less, 45% or higher extremely high elongations at room temperature are obtained. The effect of the present invention (1) is most strongly exhibited. Note that the amount of increase in weight due to oxidation during heat treatment in the air at 700° C. for 200 hours was, in the examples of the present invention, about the same level as that of the pure titanium of Test No. 1 and the Al-added titanium alloys of Test Nos. 2 and 3.

However, in Test No. 4, while a high 40.6% room temperature elongation was obtained, the 0.2% yield strengths at 550° C., 625° C., and 700° C. were 100 MPa, 80 MPa, and 30 MPa or less, that is, a sufficient improvement was not achieved in the high temperature strength. Further, Test No. 11 also exhibited at a high 37.2% room temperature elongation, but the 0.2% yield strengths at 625° C. and 700° C. were 80 MPa and 30 MPa or less, i.e., the improvement in the high temperature strength was not sufficient.

The reason is that, in Test No. 4, the amount of addition of Cu is less than the lower limit value of 0.3% of the present invention, so the amount of Cu in solid solution required for improving the high temperature strength was insufficient. In Test No. 11, the content of Fe, the β-phase stabilization element, is over the upper limit value of 0.30% of the present invention, so the amount of the β-phase increases, Cu concentrates there heavily, and the amount in solid solution in the α-phase required for improvement of the high temperature strength falls.

Further, in Test Nos. 8 and 14, the high temperature strengths were sufficiently high, but the room temperature elongations were both not more than 35% or were considerably lower values compared with JIS Class 2 pure titanium. This is because, in Test No. 8, Cu is added over the upper limit value of 1.8% of the present invention, so a large amount of the $Ti_2Cu$ phase is produced and the cold ductility is impaired. In Test No. 14, the content of oxygen is over the upper limit value of 0.18% of the present invention, so the twinning deformation is suppressed and the cold deformability drops.

In the above way, the titanium alloy sheet comprised of the elements defined in the present invention is provided with excellent cold workability and high temperature strength and, further, has high temperature oxidation characteristics on a par with pure titanium, but if deviating from the amounts of alloying elements defined in the present invention, both the cold workability and the high temperature strength cannot be achieved.

Note that in the present example, as shown in Table 1, the totals of the volume percentages of the $Ti_2Cu$ phase and β-phase were all 2% or less and the distributions were spotty grains.

Example 2

VAR (vacuum arc remelting) was used to remelt the titanium material of each composition shown in Table 2. This was hot forged to form a slab which was then heated to 860° C., then hot rolled by a hot continuous rolling mill to a strip of a thickness of 3.5 mm.

This hot rolled strip was continuously annealed with air cooling at 720° C.×2 minutes (hot-rolled coil annealing), then the oxide scale was removed by shot blast and pickling, then the strip was cold rolled to a strip of a thickness of 1 mm. After this, the strip was vacuum annealed with furnace cooling at 680° C.×4 hours (final annealing). A tensile test piece was taken in parallel with the rolling direction and was used for tensile tests at room temperature and 700° C.

The strength characteristics were evaluated by the 0.2% yield strength, while the workability was evaluated by the elongation value at room temperature. Further, a 30 mm×30 mm square test piece was heat treated at 700° C.×200 hours in the air and measured for increase in weight due to oxidation. Further, examination of the structure by a scan type electron microscope reveals second phases ($Ti_2Cu$ phase and β-phase). The area rate was calculated by image analysis so as to find the volume percentage of the second phases. The results of these evaluations are shown together in Table 2.

TABLE 2

| Test no. | Cu (mass %) | Sn (mass %) | Zr (mass %) | Mo (mass %) | Nb (mass %) | Cr (mass %) | Fe (mass %) | O (mass %) | Room temperature 0.2% yield strength (MPa) | Room temperature elongation (%) | 700° C. 0.2% yield strength (MPa) | 700° C., 200 h oxidation weight increase (mg/cm$^2$) | Total amount of $Ti_2Cu$, β-phase (volume percentage) (%) | Remarks |
|---|---|---|---|---|---|---|---|---|---|---|---|---|---|---|
| 19 | 0.8 | 1.3 | — | — | — | — | 0.05 | 0.08 | 303 | 38.0 | 42 | 2.84 | 1.4 | Inv. (2), (3) |
| 20 | 0.8 | 1.7 | — | — | — | — | 0.05 | 0.08 | 310 | 37.0 | 45 | 2.82 | 2.1 | Comp. ex. |
| 21 | 0.8 | — | 1.3 | — | — | — | 0.05 | 0.08 | 302 | 39.2 | 48 | 2.85 | 1.3 | Inv. (2), (3) |
| 22 | 0.8 | — | 1.8 | — | — | — | 0.05 | 0.08 | 318 | 33.0 | 45 | 2.79 | 2.1 | Comp. ex. |
| 23 | 0.8 | — | — | 1.4 | — | — | 0.05 | 0.08 | 301 | 39.3 | 48 | 2.84 | 1.5 | Inv. (2), (3) |
| 24 | 0.8 | — | — | 1.7 | — | — | 0.05 | 0.08 | 318 | 32.8 | 48 | 2.80 | 2.1 | Comp. ex. |
| 25 | 0.8 | — | — | — | 1.4 | — | 0.05 | 0.08 | 299 | 38.7 | 46 | 2.81 | 1.4 | Inv. (2), (3) |
| 26 | 0.8 | — | — | — | 1.8 | — | 0.05 | 0.08 | 321 | 31.5 | 45 | 2.74 | 2.1 | Comp. ex. |
| 27 | 0.8 | — | — | — | — | 1.2 | 0.05 | 0.08 | 298 | 36.8 | 49 | 2.86 | 1.2 | Inv. (2), (3) |
| 28 | 0.8 | — | — | — | — | 1.6 | 0.05 | 0.08 | 320 | 31.2 | 50 | 2.86 | 2.1 | Comp. ex. |
| 29 | 0.8 | 0.5 | 0.7 | — | — | — | 0.05 | 0.08 | 299 | 38.8 | 44 | 2.79 | 1.3 | Inv. (2), (3) |
| 30 | 0.8 | 0.5 | — | 0.7 | — | — | 0.05 | 0.08 | 297 | 37.7 | 46 | 2.79 | 1.3 | Inv. (2), (3) |
| 31 | 0.8 | 0.5 | — | — | 0.6 | — | 0.05 | 0.08 | 295 | 36.6 | 44 | 2.74 | 1.3 | Inv. (2), (3) |
| 32 | 0.8 | 0.5 | — | — | — | 0.5 | 0.05 | 0.08 | 290 | 37.9 | 45 | 2.81 | 1.2 | Inv. (2), (3) |
| 33 | 0.8 | — | 0.5 | 0.5 | 0.3 | — | 0.05 | 0.08 | 302 | 36.0 | 44 | 2.77 | 1.5 | Inv. (2), (3) |
| 34 | 0.8 | — | — | 0.5 | 0.3 | 0.5 | 0.05 | 0.08 | 305 | 37.5 | 47 | 2.77 | 1.6 | Inv. (2), (3) |
| 35 | 0.8 | — | — | 0.2 | 1.0 | — | 0.05 | 0.08 | 310 | 37.7 | 42 | 2.74 | 1.4 | Inv. (2), (3) |
| 36 | 0.8 | 0.5 | — | 0.8 | — | 0.5 | 0.05 | 0.08 | 325 | 29.8 | 50 | 2.76 | 2.2 | Comp. ex. |
| 37 | 0.8 | 0.8 | — | — | — | 0.8 | 0.05 | 0.08 | 327 | 30.5 | 49 | 2.80 | 2.2 | Comp. ex. |
| 38 | 1.1 | — | — | — | — | 0.8 | 0.06 | 0.12 | 293 | 38.2 | 43 | 2.87 | 1.5 | Inv. (2), (3) |
| 39 | 1.1 | — | — | — | 0.5 | — | 0.06 | 0.12 | 272 | 37.8 | 45 | 2.84 | 0.9 | Inv. (2), (3) |
| 40 | 1.1 | — | — | 1.0 | — | — | 0.06 | 0.12 | 290 | 39.3 | 47 | 2.81 | 0.9 | Inv. (2), (3) |
| 41 | 1.1 | — | 0.9 | — | — | — | 0.06 | 0.12 | 292 | 40.1 | 44 | 2.80 | 1.2 | Inv. (2), (3) |
| 42 | 1.1 | 0.9 | — | — | — | — | 0.06 | 0.12 | 288 | 37.5 | 46 | 2.79 | 1.4 | Inv. (2), (3) |
| 43 | 1.0 | — | — | — | — | 0.33 | 0.04 | 0.07 | 285 | 37.9 | 44 | 2.89 | 0.4 | Inv. (2), (3) |

TABLE 2-continued

| Test no. | Cu (mass %) | Sn (mass %) | Zr (mass %) | Mo (mass %) | Nb (mass %) | Cr (mass %) | Fe (mass %) | O (mass %) | Room temperature 0.2% yield strength (MPa) | Room temperature elongation (%) | 700° C. 0.2% yield strength (MPa) | 700° C., 200 h oxidation weight increase (mg/cm$^2$) | Total amount of $Ti_2Cu$, β-phase (volume percentage) (%) | Remarks |
|---|---|---|---|---|---|---|---|---|---|---|---|---|---|---|
| 44 | 1.0 | — | — | — | 0.4 | — | 0.04 | 0.07 | 271 | 37.5 | 46 | 2.88 | 0.5 | Inv. (2), (3) |
| 45 | 1.0 | — | — | 0.4 | — | — | 0.04 | 0.07 | 288 | 39.5 | 48 | 2.87 | 0.3 | Inv. (2), (3) |
| 46 | 1.0 | — | 0.4 | — | — | — | 0.04 | 0.07 | 295 | 40.2 | 45 | 2.87 | 0.3 | Inv. (2), (3) |
| 47 | 1.0 | 0.5 | — | — | — | — | 0.04 | 0.07 | 289 | 37.3 | 47 | 2.89 | 0.4 | Inv. (2), (3) |
| 48 | 1.0 | — | — | — | — | 0.2 | 0.04 | 0.07 | 283 | 37.7 | 37 | 2.95 | * | Inv. (1), (3) |
| 49 | 1.0 | — | — | — | 0.2 | — | 0.04 | 0.07 | 270 | 38.0 | 38 | 2.96 | * | Inv. (1), (3) |
| 50 | 1.0 | — | — | 0.2 | — | — | 0.04 | 0.07 | 286 | 39.3 | 38 | 2.94 | * | Inv. (1), (3) |
| 51 | 1.0 | — | 0.2 | — | — | — | 0.04 | 0.07 | 292 | 41.0 | 39 | 2.95 | * | Inv. (1), (3) |
| 52 | 1.0 | 0.2 | — | — | — | — | 0.04 | 0.07 | 285 | 38.1 | 39 | 2.94 | * | Inv. (1), (3) |

* below detection limit

In Table 2, Test Nos. 19, 21, 23, 25, 27, 29, 30, 31, 32, 33, 34, and 35 representing examples of the present invention produced by the method described in the present invention (3) all had high elongations at room temperature of over 35%. Further, compared with Test No. 6 comprised of the same amounts of Cu, Fe, and oxygen, the 0.2% yield strengths at 700° C. became at least 7 MPa higher. The effect of addition of Sn, Zr, Mo, Nb, and Cr alone or combined was therefore exhibited.

Further, the increases in weight due to oxidation during heat treatment in the air at 700° C. for 200 hours were also smaller than that of Test No. 6—less than 2.90 mg/cm$^2$ in each case, i.e., an improvement in high temperature oxidation resistance was also achieved. This was due to the effect of addition of Sn, Zr, Mo, Nb, or Cr alone or in combination.

Test Nos. 20, 22, 24, 26, 28, 36, 37 exhibited 0.2% yield strengths at 700° C. higher than Test No. 6 and increases in weight due to oxidation during heat treatment in the air at 700° C. for 200 hours smaller than Test No. 6. The high temperature strengths and the high temperature oxidation characteristics were improved, but the room temperature elongations were less than 35% in each case, i.e., the workabilities ended up being impaired.

This is because the total of the amounts of addition of the one or more of Sn, Zr, Mo, Nb, and Cr was over the upper limit value of 1.5% of the present invention, so the precipitation of $Ti_2Cu$ was promoted and the workability was impaired.

Test Nos. 38 to 42 are examples of the present invention (2) comprised of the alloy of Test No. 12 t which Sn, Zr, Mo, Nb, and Cr are further added. Since the amounts of addition were suitable, high room temperature elongations of 35% or more, 0.2% yield strengths at 700° C. of over that of Test No. 12, and high temperature oxidation characteristics during heat treatment in the air at 700° C. for 200 hours were achieved.

Test Nos. 43 to 52 are examples of the alloy of Test No. 16 to which Sn, Zr, Mo, Nb, and Cr are added. Test Nos. 43 to 47 to which suitable amounts were added as prescribed in the present invention (2) achieved high room temperature elongations of 35% or more, high temperature strengths (0.2% yield strengths at 700° C.) higher than Test No. 16 by more than 5 MPa, and high high-temperature oxidation characteristics (high temperature oxidation characteristics during heat treatment in the air at 700° C. for 200 hours) were achieved. On the other hand, Test Nos. 48, 49, 50, 51, and 52 in which the amounts of addition of Sn, Zr, Mo, Nb, and Cr were less than the 0.3% prescribed by the present invention (2) had margins of improvement of the high temperature strength of at most 3 MPa, and the margin of improvement of the high temperature oxidation characteristics was little.

Note that in the present example, as shown in Table 2, the totals of the volume percentages of the $Ti_2Cu$ phase and β-phase were all 2% or less and the distributions were spotty grains.

Example 3

Sheets were taken from the intermediate products when producing the materials of Test No. 6 of Table 1 and Test Nos. 29, 34 and 44 of Table 2, that is, hot rolled strips of 3.5 mm thickness. These were hot-rolled sheet annealed under the conditions shown in Tables 3 to 6, the oxide scales were removed by shot blast and pickling, then these were cold rolled to 1 mm thick strips. After this, each strip was cold-rolled sheet annealed under the conditions described in Tables 3 to 6 (final annealing). A tensile test piece was taken in parallel to the rolling direction and was used for tensile tests at room temperature and 700° C.

The strength characteristics were evaluated by the 0.2% yield strength, while the workability was evaluated by the elongation value at room temperature. Further, a 30 mm×30 mm square test piece was heat treated at 700° C.×200 hours in the air and measured for increase in weight due to oxidation. Further, examination of the structure by a scan type electron microscope reveals second phases ($Ti_2Cu$ phase and β-phase). The area rate was calculated by image analysis so as to find the volume percentage of the second phases. The results of these evaluations are shown together in Tables 3 to 6.

TABLE 3

| Test no. | Hot-rolled sheet annealing conditions | Cold-rolled sheet annealing conditions | Room temperature 0.2% yield strength (MPa) | Room temperature elongation (%) | 700° C. 0.2% yield strength (MPa) | 700° C., 200 h oxidation weight increase (mg/cm$^2$) | Total amount of $Ti_2Cu$, β-phase (volume percentage) (%) | Remarks |
|---|---|---|---|---|---|---|---|---|
| 53 | 720° C., 2 min, air cooling | 580° C., 6 h, furnace cooling | 218 | 40.0 | 31 | 2.98 | * | Inv. (1) |
| 54 | " | 630° C., 4 h, furnace cooling | 209 | 40.3 | 35 | 2.98 | * | Inv. (1), (4) |
| 55 | " | 680° C., 4 h, furnace cooling | 207 | 41.0 | 35 | 2.96 | * | Inv. (1), (3) |
| 56 | " | 780° C., 30 min, furnace cooling | 205 | 42.0 | 34 | 2.98 | 0.1 | Inv. (1), (3) |
| 57 | " | 810° C., 5 min, air cooling | 200 | 42.3 | 34 | 2.95 | 0.3 | Inv. (1), (3) |
| 58 | " | 850° C., 3 min, air cooling | 198 | 42.5 | 31 | 2.96 | 1.0 | Inv. (1) |
| 59 | 630° C., 10 min, air cooling | 630° C., 4 h, furnace cooling | 207 | 40.8 | 32 | 2.99 | * | Inv. (1) |
| 60 | " | 680° C., 4 h, furnace cooling | 209 | 40.5 | 35 | 2.95 | * | Inv. (1), (3) |
| 61 | " | 780° C., 30 min, furnace cooling | 207 | 41.0 | 36 | 3.00 | 0.2 | Inv. (1), (3) |
| 62 | " | 810° C., 5 min, air cooling | 201 | 41.0 | 34 | 2.99 | 0.3 | Inv. (1), (3) |
| 63 | " | 850° C., 3 min, air cooling | 197 | 42.8 | 31 | 3.01 | 1.0 | Inv. (1) |
| 64 | 850° C., 2 min, air cooling | 630° C., 4 h, furnace cooling | 207 | 42.2 | 31 | 2.95 | * | Inv. (1) |
| 65 | " | 680° C., 4 h, furnace cooling | 208 | 40.5 | 36 | 2.93 | * | Inv. (1), (3) |
| 66 | " | 780° C., 30 min, furnace cooling | 208 | 41.2 | 36 | 2.98 | 0.2 | Inv. (1), (3) |
| 67 | " | 810° C., 5 min, air cooling | 201 | 42.3 | 35 | 2.98 | 0.3 | Inv. (1), (3) |
| 68 | " | 850° C., 3 min, air cooling | 190 | 43.3 | 32 | 3.00 | 1.0 | Inv. (1) |

* below detection limit

TABLE 4

| Test no. | Hot-rolled sheet annealing conditions | Cold-rolled sheet annealing conditions | Room temperature 0.2% yield strength (MPa) | Room temperature elongation (%) | 700° 0.2% yield strength (MPa) | 700° C., 200 h oxidation weight increase (mg/cm$^2$) | Total amount of $Ti_2Cu$, β-phase (volume percentage) (%) | Remarks |
|---|---|---|---|---|---|---|---|---|
| 69 | 720° C., 2 min, air-cooling | 630° C., 4 h, furnace cooling | 302 | 37.7 | 46 | 2.82 | 1.5 | Inv. (2), (4) |
| 70 | " | 680° C., 4 h, furnace cooling | 299 | 38.8 | 44 | 2.80 | 1.3 | Inv. (2), (3) |
| 71 | " | 780° C., 30 min, furnace cooling | 290 | 38.7 | 47 | 2.82 | 0.7 | Inv. (2), (3) |
| 72 | " | 810° C., 5 min, air-cooling | 285 | 39.5 | 46 | 2.80 | 1.0 | Inv. (2), (3) |
| 73 | " | 850° C., 3 min, air-cooling | 281 | 39.6 | 40 | 2.79 | 1.4 | Inv. (2) |

TABLE 5

| Test no. | Hot-rolled sheet annealing conditions | Cold-rolled sheet annealing conditions | Room temperature 0.2% yield strength (MPa) | Room temperature elongation (%) | 700° C. 0.2% yield strength (MPa) | 700° C., 200 h oxidation weight increase (mg/cm$^2$) | Total amount of $Ti_2Cu$, β-phase (volume percentage) (%) | Remarks |
|---|---|---|---|---|---|---|---|---|
| 74 | 630° C., 10 min, air-cooling | 630° C., 4 h, furnace cooling | 311 | 36.5 | 40 | 2.84 | 1.6 | Inv. (2) |
| 75 | 680° C., 5 min, air-cooling | " | 308 | 37.4 | 46 | 2.81 | 1.6 | Inv. (2), (4) |
| 76 | 720° C., 2 min, air-cooling | " | 305 | 37.5 | 47 | 2.78 | 1.3 | Inv. (2), (4) |
| 77 | 810° C., 2 min, air-cooling | " | 298 | 38.1 | 46 | 2.79 | 1.3 | Inv. (2), (4) |
| 78 | 850° C., 2 min, air cooling | " | 290 | 38.3 | 41 | 2.81 | 1.3 | Inv. (2) |

Table 3 shows the results of tests on materials of the same composition as in Test No. 6. Regardless of the conditions of the hot-rolled sheet annealing, Test Nos. 55, 56, 57, 60, 61, 62, 65, 66, and 67 involving final annealing, that is, cold-rolled sheet annealing, at 630 to 850° C. in temperature range all gave high room temperature elongations of over 40% and high 0.2% yield strengths at 700° C. of over 34 MPa. The oxidation resistances were also on the level of pure titanium.

In this way, by applying the method described in the present invention 3, it is possible to produce products featuring all of room temperature workability, high temperature strength, and high temperature oxidation resistances.

Further, Test No. 54 had a temperature of the final annealing, that is, the cold-rolled sheet annealing, of 630° C. This was outside the range of conditions prescribed in the present invention (3), but a high room temperature elongation of over 40%, a high 0.2% yield strength at 700° C. of over 34 MPa, and oxidation resistances on a par with pure titanium were exhibited. This was because the annealing before the cold rolling, that is, the hot-rolled sheet annealing, was conducted at 630 to 850° C. in temperature range, so the effects of the present invention (4) were exhibited.

Note that Test Nos. 53, 58, 59, 63, 64, 68 all gave high room temperature elongations of over 40% and high 0.2% yield strengths a 700° C. of over 30 MPa, but compared with the invention examples, the high temperature strengths became somewhat lower. The reason is as follows:

However, Test No. 73 which involved final annealing, that is, the cold-rolled sheet annealing, performed outside of the temperature range prescribed in the present invention (3) or (4) had a 0.2% yield strength at 700° C. somewhat lower compared with the examples of Test Nos. 69 to 72.

Further, Table 5 shows the results of tests on materials of the same composition as Test No. 34. The cold-rolled and annealed sheets of Test Nos. 75 to 77 produced by the method described in the present invention (4) all gave high room temperature elongations of over 35%, high 0.2% yield strengths at 700° C. of over 46 MPa, and excellent high temperature oxidation resistances.

However, in Test Nos. 74 and 78 involving annealing before the cold-rolling, that is the hot-rolled sheet annealing, performed outside of the 630 to 850° C. temperature range prescribed in the present invention (4) and involving final annealing, that is, cold-rolled sheet annealing, performed outside of the temperature range prescribed in the present invention (3), the 0.2% yield strengths at 700° C. became somewhat lower compared with the examples of Test Nos. 75 to 77.

Further, Table 6 shows the results of tests on materials of the same composition as Test No. 44. Test No. 80 produced by the method described in the present invention (3) and Test No. 81 produced by the method described in the present invention (4) both gave high room temperature elongations equal to Test No. 44, high 0.2% yield strengths at 700° C., and excellent high temperature oxidation resistances.

TABLE 6

| Test no. | Hot-rolled sheet annealing conditions | Cold-rolled sheet annealing conditions | Room temperature 0.2% yield strength (MPa) | Room temperature elongation (%) | 700° C. 0.2% yield strength (MPa) | 700° C., 200 h oxidation weight increase (mg/cm$^2$) | Total anomtof $Ti_2Cu$, β-phase (volume percentage) (%) | Remarks |
|---|---|---|---|---|---|---|---|---|
| 80 | 810° C., 2 min, air-cooling | 700° C., 4 h, furnace cooling | 268 | 39.2 | 45 | 2.85 | 0.5 | Inv. (2), (3) |
| 81 | 810° C., 2 min, air-cooling | 640° C., 4 h, furnace cooling | 275 | 37.0 | 48 | 2.88 | 0.7 | Inv. (2), (4) |

Test No. 53 involved the annealing before cold rolling, that is, the hot-rolled sheet annealing, performed at the 630 to 850° C. temperature range prescribed in the present invention (4), but the final annealing, that is, the cold-rolled sheet annealing, was conducted at less than the 600° C. prescribed in the present invention (4), so the margin of improvement of the high temperature strength ended up becoming somewhat small. Test No. 58 had a final annealing, that is, a cold-rolled sheet annealing, outside of the temperature range prescribed by the present invention (3) or (4), so the margin of improvement of the high temperature strength ended up becoming somewhat smaller.

Test Nos. 59, 63, 64, and 68 had annealing before the cold rolling, that is, the hot-rolled sheet annealing, performed outside the 630 to 850° C. temperature range prescribed in the present invention (4) and had final annealing, that is, cold-rolled sheet annealing, outside the temperature range prescribed in the present invention (3), so the margin of improvement of the high temperature strength became somewhat small.

Now, Table 4 shows the results of tests on materials of the same composition as Test No. 29. The cold-rolled and annealed sheets produced by the method of present invention (3) or (4) (Test Nos. 69 to 72) all gave high room temperature elongations of over 35%, high 0.2% yield strengths at 700° C. of over 44 MPa, and excellent high temperature oxidation resistance.

Note that in the present example, as shown in Tables 3 to 6, the totals of the volume percentages of the $Ti_2Cu$ phase and β-phase were all 2% or less and the distributions were spotty grains.

Example 4

Small-sized button arc melting was used to cast a 100 mm length×50 mm width×15 mm thickness titanium material by the composition which is shown in Table 7. This was heated to 860° C., then hot rolled to a thickness 3.5 mm hot rolled sheet (hot rolled sheet). This hot rolled sheet annealed at 720° C.×2 minutes under air-cooling conditions and was further stripped of oxide scale by shot blasting and pickling, then was cold rolled to obtain a 1 mm thickness cold rolled sheet. After that, this was vacuum annealed with furnace cooling (final annealing) at 680° C.×4 hours. A tensile test piece was taken in parallel to the rolling direction and was subjected to a tensile test at room temperature and 700° C.

The strength characteristics were evaluated by the 0.2% yield strength, while the workability was evaluated by the elongation value at room temperature. Further, a 30 mm×30 mm square test piece was heat treated at 700° C.×200 hours in the air and measured for increase in weight due to oxidation. Further, examination of the structure by a scan type electron microscope reveals second phases ($Ti_2Cu$ phase and β-phase). The area rate was calculated by image analysis so as to find the volume percentage of the second phases. The results of these evaluations are shown together in Table 7.

TABLE 7

| Test no. | Cu (mass %) | Nb (mass %) | Fe (mass %) | O (mass %) | Room temperature 0.2% yield strength (MPa) | Room temperature elongation (%) | 700° C. 0.2% yield strength (MPa) | Increase in weight due to oxidation at 700° C., 200 h ($mg/cm^2$) | Total amount of $Ti_2Cu$, β-phase (volume percentage) (%) | Remarks |
|---|---|---|---|---|---|---|---|---|---|---|
| 82 | 0.8 | — | 0.06 | 0.08 | 205 | 40.2 | 25 | 3.55 | 2.3 | Comp. ex. |
| 83 | 0.8 | — | 0.27 | 0.07 | 219 | 41.0 | 26 | 3.65 | 2.8 | Comp. ex. |
| 84 | 1.2 | — | 0.05 | 0.16 | 281 | 35.7 | 27 | 3.58 | 2.6 | Comp. ex. |
| 85 | 1.5 | — | 0.05 | 0.15 | 277 | 35.5 | 29 | 3.62 | 3.9 | Comp. ex. |
| 86 | 1.1 | 0.6 | 0.06 | 0.13 | 273 | 36.2 | 29 | 3.15 | 3.4 | Comp. ex. |

Now then, in Table 7, Test Nos. 82, 83, 84, 85, and 86 have almost the same compositions as Test Nos. 6, 10, 13, 15, and 39 which were shown in Table 1 and Table 2.

However, the 700° C. 0.2% yield strengths were all lower than Test Nos. 6, 10, 13, 15, and 39. The 700° C. oxidation resistances were also poorer than Test Nos. 6, 10, 13, 15, and 39.

This is because Test Nos. 82, 83, 84, 85, and 86 are produced by small-sized button arc remelting. The uniformity of chemical composition such as with large-sized cast ingots cannot be secured. For this reason, even when made thin-gauge sheet, locally, the $Ti_2Cu$ phases are present in over 2% at the α grain boundaries, etc., the high temperature strength falls, and grain boundary oxidation occurs. In fact, by examination of the structure by a scanning type of electron microscope, it was confirmed that there were parts where the second phases ($Ti_2Cu$ phase and β-phase) were formed in lamellar shapes in amounts exceeding 2%.

Example 5

Various titanium materials were produced by the systems of ingredients and production process shown in Table 8. Tensile test pieces were taken in parallel to the final rolling direction and subjected to tensile tests at 700° C. to measure the 0.2% yield strengths. Further, 30 mm×30 mm rectangular test pieces were used to perform heat treatment at 700° C.×200 hours in the atmosphere and were measured for increase in weight due to oxidation. Further, examination of the structure by a scan type electron microscope reveals second phases ($Ti_2Cu$ phase and β-phase). The area rate was calculated by image analysis so as to find the volume percentage of the second phases and investigate the structure.

The results of these evaluations are shown together in Table 8.

TABLE 8

| Test no. | System of ingredients | Production process | 700° C. 0.2% yield strength (MPa) | 700° C., 200 h increase in weight by oxidation ($mg/cm^2$) | Total amount of $Ti_2Cu$, β-phase (volume percentage) (%) | Characteristics of structure |
|---|---|---|---|---|---|---|
| 87 | Ti—0.9% Cu—0.05%Fe—0.05% O | VAR melting<br>Blooming to produce slabs of 200 mm thickness, length 5000 mm, width 1000 mm<br>Heating to 850° C. and hot strip rolling to 3 mm thickness<br>Heat treatment at β-region (900° C.), 2 min with water cooling<br>Heat treatment at 400° C., 10 h with air cooling<br>Shot blasting + pickling, then cold rolling to 1 mm thickness<br>Annealing at 650° C., 5 h | 28 | 3.47 | 5.8 | Lamellar β-phase, $Ti_2Cu$ phase at grain boundaries of equiaxial α-phase |
| 88 | Ti—1.0% Cu—0.03% Fe—0.12% O | VAR melting-<br>Blooming to produce slabs of 150 mm thickness, length 300 mm, width 200 mm<br>Heating to 850° C. and hot sheet rolling to 10 mm thickness<br>Annealing at 630° C. for several hours using vacuum creep corrector | 21 | 3.39 | 7.2 | Lamellar β-phase, $Ti_2Cu$ phase at grain boundaries of equiaxial α-phase |
| 89 | Ti—1.0% Cu—0.03% Fe—0.05% O | VAR melting<br>Blooming to produce slabs of 150 mm thickness, Length 300 mm, width 200 mm<br>Heating to 850° C. and hot sheet rolling to 10 mm thickness<br>Shot blasting + pickling, then cold rolling to 5 mm thickness<br>Annealing at 750° C., 1 h with air cooling | 28 | 3.38 | 2.8 | Lamellar β-phase, $Ti_2Cu$ phase at grain boundaries of equiaxial α-phase |
| 90 | Ti—1.0%Cu—0.02% Fe-0.05% O | Button arc melting to produce width 100 mm, length 300 mm, thickness 15 mm cast ingot<br>Heating to 1000° C. and hot rolling to 10 mm thickness + heating to 900° C. and hot rolling to 5.5 mm | 26 | 3.56 | 2.5 | Lamellar β-phase, $Ti_2Cu$ phase at grain boundaries of equiaxial α-phase |

TABLE 8-continued

| Test no. | System of ingredients | Production process | 700° C. 0.2% yield strength (MPa) | 700° C., 200 h increase in weight by oxidation (mg/cm$^2$) | Total amount of $Ti_2Cu$, β-phase (volume percentage) (%) | Characteristics of structure |
|---|---|---|---|---|---|---|
| | | Shot blasting + pickling, then cold rolling to 1 mm thickness<br>Annealing at 700° C., 1 h with air cooling | | | | |
| 91 | Ti—1.5% Cu—0.08% Fe—0.05% O | Button arc melting to produce width 100 mm, length 300 mm, thickness 15 mm cast ingot<br>Heating to 1000° C. and hot rolling to 10 mm thickness + heating to 800° C. and hot rolling to 5.5 mm<br>Annealing at 700° C., 1 h with air cooling | 25 | 4.55 | 4.5 | Partially with parts with large β-phases and $Ti_2Cu$ phases |
| 92 | Ti—1.6% Cu—0.03% Fe—0.05% O | Button arc melting to produce width 100 mm, length 300 mm, thickness 25 mm cast ingot<br>Heating to 1000° C. and hot rolling to 12 mm thickness + heating to 800° C. and hot rolling to 7 mm thickness<br>Shot blasting + pickling, then cold rolling to 3 mm thickness<br>Annealing at 700° C., 1 h with air cooling | 28 | 3.66 | 2.5 | Lamellar β-phase, $Ti_2Cu$ phase at grain boundaries of equiaxial α-phase |
| 93 | Ti—0.6% Cu—0.09% Fe—0.05% O | Button arc melting to produce width 100 mm, length 300 mm, thickness 25 mm cast ingot<br>Heating to 1000° C. and hot rolling to 12 mm thickness + heating to 800° C. and hot rolling to 7 mm thickness<br>Annealing at 700° C., 1 h with air cooling | 25 | 3.57 | 2.5 | Partially with parts with large β-phases and $Ti_2Cu$ phases |

Test No. 87 was a sheet which was obtained by heat treating to the β-region a 3 mm thickness hot rolled sheet which was rolled by an actual mill by large strip rolling, heat treating by water cooling, further heat treating at 400° C. for 10 hours, then cold rolling to obtain a 1 mm thickness sheet then subjecting it to annealing at 630° C. for 5 hours.

The ingredients were similar to those of Test Nos. 16 and 17 of the present invention, but the 700° C. 0.2% yield strength was lower than these and the increase in weight due to oxidation was greater. This is because due to the $Ti_2Cu$ phase and β-phase being contained in over 2%, the high temperature strengthening ability of Cu was lost and a β-phase $Ti_2Cu$ phase continuing from the grain boundaries was present, so the high temperature oxidation resistance also deteriorated. Such structural features are believed to be due to the fact that when water cooling from the β-region, a needle-shape α-phase was formed, a $Ti_2Cu$ phase was formed in a large amount between these, the phase was stabilized by subsequent heat treatment at 400° C. for 10 hours, and even when performing the final annealing at 630° C. where the $Ti_2Cu$ phase becomes smaller, the $Ti_2Cu$ phase could not be sufficiently melted.

Test Nos. 88 and 89 were sheets obtained by preparing slabs of the dimensions described in Table 8 by blooming from cast ingots which were produced by VAR melting and producing sheets based on these for evaluation.

However, these were all sheets which were produced by remelting and hot rolling and cold rolling of sheets in a small-scale laboratory. In the same way as the small-sized remelted and single rolled materials which were explained in Example 4, these lacked uniformity and had partially greater $Ti_2Cu$ phases and β-phases along the α grain boundaries, fell in high temperature strength, suffered from grain boundary oxidation, and deteriorated in high temperature characteristics compared with the similar composition present invention (Test Nos. 12, 13, 16, and 17).

Test Nos. 90 to 93 show results of evaluation of sheets which were obtained by rolling from 100 mm width, 300 mm length, 15 mm thickness ingots which were produced by button arc melting. All were lower in high temperature strength and higher in increase in weight due to oxidation at a high temperature compared with the similar composition Test Nos. 5, 6, 15, 16, 17, 18, etc. This is because, as explained in Example 4, the materials are produced by small-sized button arc remelting. The uniformity of chemical composition such as with large-sized cast ingots cannot be secured. For this reason, even when made thin-gauge sheet, locally, the $Ti_2Cu$ phases are present in over 2% at the α grain boundaries, the high temperature strength falls, and grain boundary oxidation occurs.

Note that the titanium alloy sheet according to the present invention sufficiently exhibits the effects of the present invention so long containing the ingredients of the present invention (1) or (2) and satisfying the requirement of the β-phases and $Ti_2Cu$ phases being a total of a volume percentage of 2% or less. It is not limited to the method of production which is shown above.

INDUSTRIAL APPLICABILITY

The titanium alloy sheet of the present invention can be particularly utilized for parts of an exhaust system of two-wheeled and four-wheeled automobiles, that is, the exhaust manifold, exhaust pipe, muffler, and other parts used for the discharge route of burned exhaust gas.

The invention claimed is:

1. A heat resistant titanium alloy sheet excellent in cold workability comprising, by mass %, 0.3 to 1.8% of Cu, 0.18% or less of oxygen, 0.30% or less of Fe, and a balance of Ti and less than 0.3% of impurity elements, and further comprising a β-phase and $Ti_2Cu$-phase in total having a volume percentage of 2%, and a balance of an α-phase, wherein said titanium alloy sheet further contains at least one or more of Sn, Zr, Mo, Nb, and Cr in a total of 0.3 mass % to 1.5 mass %.

2. A heat resistant titanium alloy sheet excellent in cold workability comprising, by mass %, 0.3 to 1.8% of Cu, 0.18% or less of oxygen, 0.30% or less of Fe, and a balance of Ti and less than 0.3% of impurity elements, and further comprising a β-phase and $Ti_2Cu$-phase in total having a volume percentage of 0.1% or less and a balance of an α-phase, wherein said titanium alloy sheet further contains at least one or more of Sn, Zr, Mo, Nb, and Cr in a total of 0.3 mass % to 1.5 mass %.

* * * * *